US007736183B2

(12) United States Patent
Trout et al.

(10) Patent No.: US 7,736,183 B2
(45) Date of Patent: Jun. 15, 2010

(54) CONNECTOR ASSEMBLY WITH VARIABLE STACK HEIGHTS HAVING POWER AND SIGNAL CONTACTS

(75) Inventors: David Allison Trout, Lancaster, PA (US); James Lee Fedder, Etters, PA (US); Daniel Robert Ringler, Elizabethville, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/250,299

(22) Filed: Oct. 13, 2008

(65) Prior Publication Data

US 2010/0093194 A1 Apr. 15, 2010

(51) Int. Cl.
*H01R 13/648* (2006.01)

(52) U.S. Cl. ..... 439/607.1

(58) Field of Classification Search ..... 439/608, 439/63, 584, 74, 581
See application file for complete search history.

(56) References Cited

U.S. PATENT DOCUMENTS

| | | | | |
|---|---|---|---|---|
| 4,012,095 | A * | 3/1977 | Doucet et al. | 439/63 |
| 4,428,632 | A | 1/1984 | Rich | |
| 4,895,521 | A | 1/1990 | Grabbe | |
| 4,895,522 | A | 1/1990 | Grabbe | |
| RE36,065 | E | 1/1999 | Andrews et al. | |
| 5,904,581 | A * | 5/1999 | Pope et al. | 439/74 |
| 6,027,345 | A * | 2/2000 | McHugh et al. | 439/66 |
| 6,083,047 | A | 7/2000 | Paagman | |
| 6,116,965 | A | 9/2000 | Arnett et al. | |
| 6,135,781 | A * | 10/2000 | Pope et al. | 439/59 |
| 6,231,391 | B1 | 5/2001 | Ramey et al. | |
| 6,310,286 | B1 | 10/2001 | Troxel et al. | |
| 6,394,822 | B1 * | 5/2002 | McNamara | 439/108 |
| 6,443,745 | B1 * | 9/2002 | Ellis et al. | 439/101 |
| 6,461,202 | B2 | 10/2002 | Kline | |
| 6,537,087 | B2 * | 3/2003 | McNamara et al. | 439/108 |
| 6,551,140 | B2 | 4/2003 | Billman et al. | |
| 6,623,280 | B2 | 9/2003 | Oldenburg et al. | |
| 6,682,368 | B2 | 1/2004 | Murr et al. | |
| 6,695,646 | B1 | 2/2004 | Grabbe | |
| 6,699,048 | B2 | 3/2004 | Johnson et al. | |
| 6,705,895 | B2 | 3/2004 | Hasircoglu | |
| 6,712,620 | B1 | 3/2004 | Li et al. | |
| 6,739,910 | B1 | 5/2004 | Wu | |
| 6,743,049 | B2 * | 6/2004 | Perugini et al. | 439/607 |
| 6,743,057 | B2 | 6/2004 | Davis et al. | |

(Continued)

FOREIGN PATENT DOCUMENTS

| | | |
|---|---|---|
| EP | 0459356 | 8/1995 |

*Primary Examiner*—T C Patel
*Assistant Examiner*—Vladimir Imas

(57) ABSTRACT

A connector assembly includes a housing, a signal contact and a power contact. The housing has a mounting body and a mating body coupled together and separated by a gap. The gap permits air to flow between the lower and mating bodies. The mating body is configured to engage an upper substrate and the mounting body is configured to engage a lower substrate to mechanically interconnect the upper and lower substrates. The signal contact extends between and protrudes from the mating and mounting bodies and is configured to communicate a data signal between the mating and mounting bodies. The power contact extends between and protrudes from the mating and mounting bodies and is configured to communicate electrical power between the upper and lower substrates. The housing separates the upper and lower substrates by a predetermined stack height.

18 Claims, 7 Drawing Sheets

U.S. PATENT DOCUMENTS 6,809,255 B1 * 10/2004 Chun ..... 174/382
6,866,521 B1 * 3/2005 Harper, Jr. ..... 439/71
6,875,056 B1 * 4/2005 Bianchini et al. ..... 439/608
6,899,550 B2 * 5/2005 Perugini et al. ..... 439/74
6,902,416 B2 * 6/2005 Feldman ..... 439/219
6,917,525 B2 7/2005 Mok et al.
6,918,776 B2 * 7/2005 Spink, Jr. ..... 439/74
6,932,618 B1 * 8/2005 Nelson ..... 439/66
6,932,655 B2 8/2005 Hatterscheid et al.
6,951,482 B1 * 10/2005 Miller et al. ..... 439/581
7,018,239 B2 3/2006 Zaderej et al.
7,021,945 B2 4/2006 Perugini et al.
7,086,872 B2 * 8/2006 Myer et al. ..... 439/78
7,086,913 B2 * 8/2006 Myer et al. ..... 439/876
7,097,470 B2 8/2006 Harper
7,207,807 B2 4/2007 Fogg
7,244,125 B2 * 7/2007 Brown et al. ..... 439/66
7,262,672 B2 8/2007 Lee et al.
7,309,239 B2 12/2007 Shuey et al.
7,390,194 B1 * 6/2008 Crippen et al. ..... 439/65
7,429,176 B2 * 9/2008 Johnescu et al. ..... 439/74
7,465,195 B1 * 12/2008 Kerrigan et al. ..... 439/608
7,470,149 B2 * 12/2008 Kazama et al. ..... 439/608
2001/0049207 A1 * 12/2001 Sakata et al. ..... 439/66
2002/0151218 A1 * 10/2002 Figueroa et al. ..... 439/608
2003/0027439 A1 * 2/2003 Johnescu et al. ..... 439/74
2003/0064614 A1 4/2003 Tanaka et al.
2003/0082954 A1 5/2003 Espenshade et al.
2003/0162442 A1 * 8/2003 Panella ..... 439/608
2004/0161954 A1 * 8/2004 Johnescu et al. ..... 439/74
2004/0166704 A1 * 8/2004 Perugini et al. ..... 439/74
2004/0174223 A1 9/2004 Achyut
2007/0197095 A1 8/2007 Feldman et al.
2008/0032524 A1 * 2/2008 Lemke et al. ..... 439/78
2008/0188098 A1 * 8/2008 Boesch et al. ..... 439/74
2008/0214059 A1 9/2008 Rothermel et al.
2008/0233806 A1 9/2008 Rothermel et al.

* cited by examiner

CONNECTOR ASSEMBLY WITH VARIABLE STACK HEIGHTS HAVING POWER AND SIGNAL CONTACTS

BACKGROUND OF THE INVENTION

The invention relates generally to electrical connectors and, more particularly, to a connector assembly that mechanically and electrically connects substrates.

Known mezzanine connectors mechanically and electrically interconnect a pair of circuit boards. The mezzanine connectors engage each of the circuit boards to mechanically interconnect the circuit boards. The circuit boards are separated from one another by a stack height when interconnected by the mezzanine connector. Signal contacts in the mezzanine connector mate with the circuit boards and provide an electrical connection between the circuit boards. The signal contacts permit the communication of data or control signals between the circuit boards. While the signal contacts may permit the communication of electric power between the circuit boards, the amount of electric current that may be communicated using the signal contacts is relatively small. For example, the electric power may be communicated between the circuit boards to supply electric power to a component connected to one of the circuit boards. The relatively low amount of electric current that may be communicated using the signal contacts in known mezzanine connectors limits the amount of electric power that can be provided to the components. As a result, the range of components that may receive electric power from a circuit board through the mezzanine connector is limited.

In order to supply a greater amount of electric power between circuit boards, additional power connectors must be used to connect the circuit boards. For example, some electrical components connected to the circuit boards may require more electric power than can be supplied by the signal contacts in known mezzanine connectors. Additional known power connectors that also couple the circuit boards must be added. The power connectors include power contacts that mate with the circuit boards already interconnected by the mezzanine connector. The power contacts permit the communication of increased amounts of electrical power between the circuit boards. However, the power connector that is added between the circuit boards must be of approximately the same size as the mezzanine connector. For example, the power connector must be of approximately the same height as the mezzanine connector to maintain the stack height between the circuit boards. If either of the mezzanine connector and the power connector is of a different size, then the circuit boards may not be able to mate with both connectors at the same time. Finding both a power connector and a mezzanine connector that are matched in size such that the circuit boards coupled to each connector are separated by the same stack height may be time consuming and/or impossible. Thus, a need exists for a connector system that provides for the communication of both electric power and data signals between a plurality of circuit boards while maintaining a stack height between the circuit boards.

BRIEF DESCRIPTION OF THE INVENTION

In one embodiment, a connector assembly includes a housing, a signal contact and a power contact. The housing has a mounting body and a mating body coupled together and separated by a gap. The gap permits air to flow between the mounting and mating bodies. The mating body is configured to engage an upper substrate and the mounting body is configured to engage a lower substrate to mechanically interconnect the upper and lower substrates. The signal contact extends between and protrudes from the mating and mounting bodies and is configured to communicate a data signal between the mating and mounting bodies. The power contact extends between and protrudes from the mating and mounting bodies and is configured to communicate electrical power between the upper and lower substrates. The housing separates the upper and lower substrates by a predetermined stack height.

In another embodiment, a mezzanine connector includes a housing, a signal contact and a power contact. The housing is configured to engage first and second circuit boards to mechanically interconnect the first and second circuit boards. The signal contact is held by the housing and is configured to mate with the first and second circuit boards to electrically connect the first and second circuit boards and communicate a data signal between the first and second circuit boards. The power contact is held by the housing and is configured to mate with the first and second circuit boards to electrically connect the first and second circuit boards and communicate electric power between the first and second circuit boards. The signal and power contacts concurrently mate with the first and second circuit boards to communicate the data signal and the electric power while separating the first and second circuit boards by a predetermined distance.

DETAILED DESCRIPTION OF THE INVENTION

Figure 1:
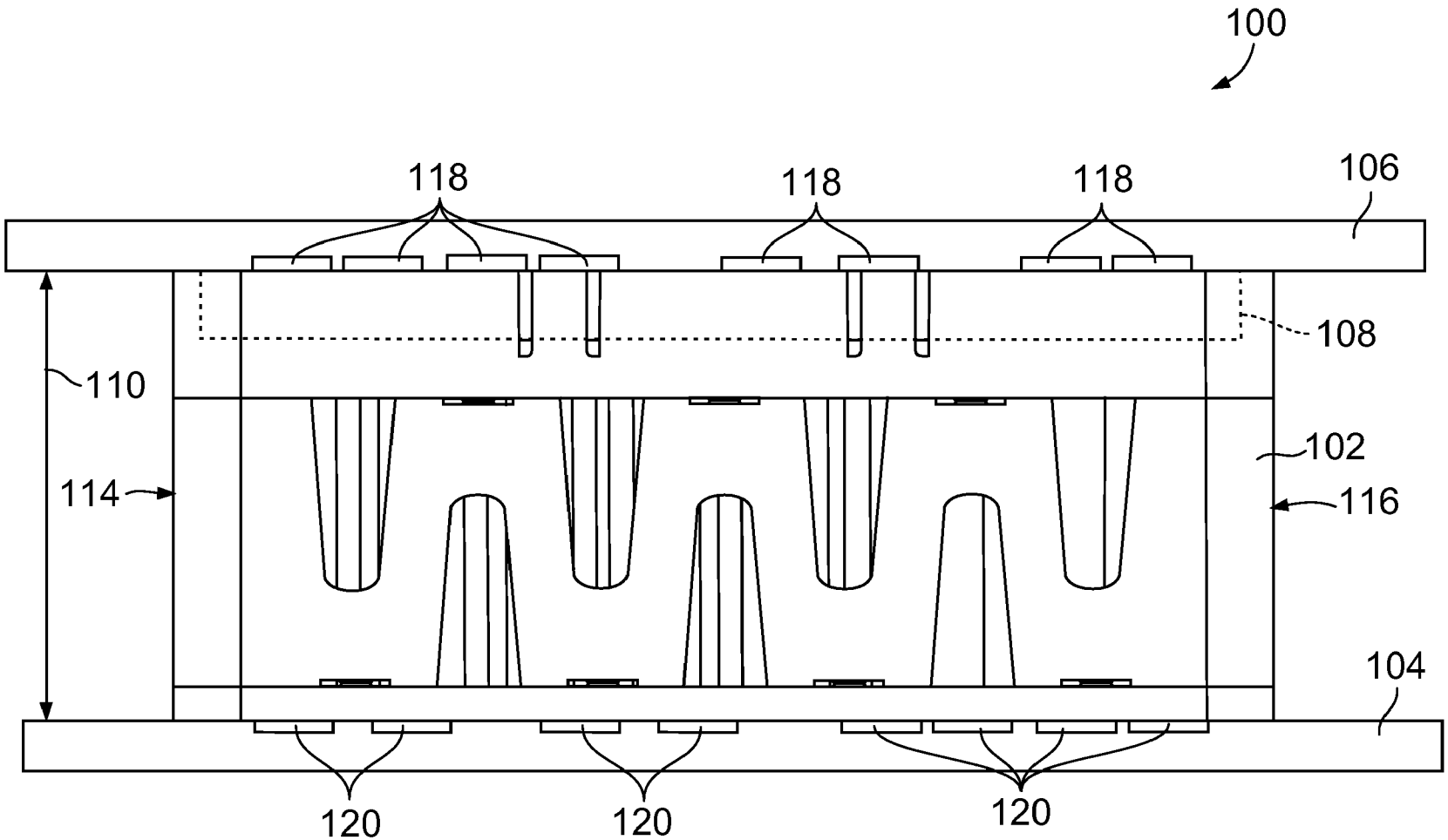
FIG. 1 is an elevational view of a connector assembly according to one embodiment.

FIG. 1 is an elevational view of a connector assembly 100 according to one embodiment. The connector assembly 100 includes a mezzanine connector assembly 102 that mechanically and electrically connects a plurality of substrates 104, 106 in a parallel arrangement. As shown in FIG. 1, the substrates 104, 106 are interconnected by the mezzanine connector assembly 102 so that the substrates 104, 106 are substantially parallel to one another. The substrates 104, 106 may include circuit boards. For example, a first, or lower, substrate 104 may be a motherboard and a second, or upper, substrate 106 may be a daughter board. The upper substrate 106 includes conductive pathways 118 and the lower substrate 104 includes conductive pathways 120. The conductive pathways 118, 120 communicate data signals and/or electric power between the substrates 106, 104 and one or more electric components (not shown) that are electrically connected to the substrates 106, 104. The conductive pathways 118, 120 may be embodied in electric traces in a circuit board, although other conductive pathways, contacts, and the like, may be the conductive pathways 118, 120. The terms upper and lower are used herein to describe the substrates 104, 106 but are not intended to limit the scope of the embodiments described herein. For example, the lower substrate 104 may be disposed above the upper substrate 106 or the substrates 104, 106 may be disposed side-by-side such that neither substrate 104, 106 is above the other. A mating connector 108 is mounted to the upper substrate 106 in the illustrated embodiment. The mezzanine connector assembly 102 is mounted to the lower substrate 104 and mates with the mating connector 108 to electrically and mechanically couple the upper and lower substrates 106, 104. In another example, the mating connector 108 is mounted to the lower substrate 104. Alternatively, the mezzanine connector assembly 102 may directly mount to each of the upper and lower substrates 106, 104 to electrically and mechanically couple the upper and lower substrates 106, 104. The upper and lower substrates 106, 104 may include electrical components (not shown) to enable the connector assembly 100 to perform certain functions. For purposes of illustration only, the connector assembly 100 may be a blade for use in a blade server. It is to be understood, however, that other applications of the inventive concepts herein are also contemplated.

The mezzanine connector assembly 102 separates the upper and lower substrates 106, 104 by a stack height 110. The stack height 110 may be approximately constant over an outer length 112 of the mezzanine connector assembly 102. The outer length 112 extends between opposite ends 114, 116 of the mezzanine connector assembly 102. Alternatively, the stack height 110 may differ or change along the outer length 112 of the mezzanine connector assembly 102. For example, the mezzanine connector assembly 102 may be shaped such that the lower and upper substrates 104, 106 are disposed transverse to one another. The stack height 110 may be varied by connecting the upper and lower substrates 106, 104 using different mezzanine connector assemblies 102 and/or mating connectors 108. The sizes of the mezzanine connector assemblies 102 and/or the mating connectors 108 may vary so that the stack height 110 may be selected by an operator. For example, an operator may select one mezzanine connector assembly 102 and/or mating connector 108 to separate the upper and lower substrates 106, 104 by a desired stack height 110.

Figure 2:
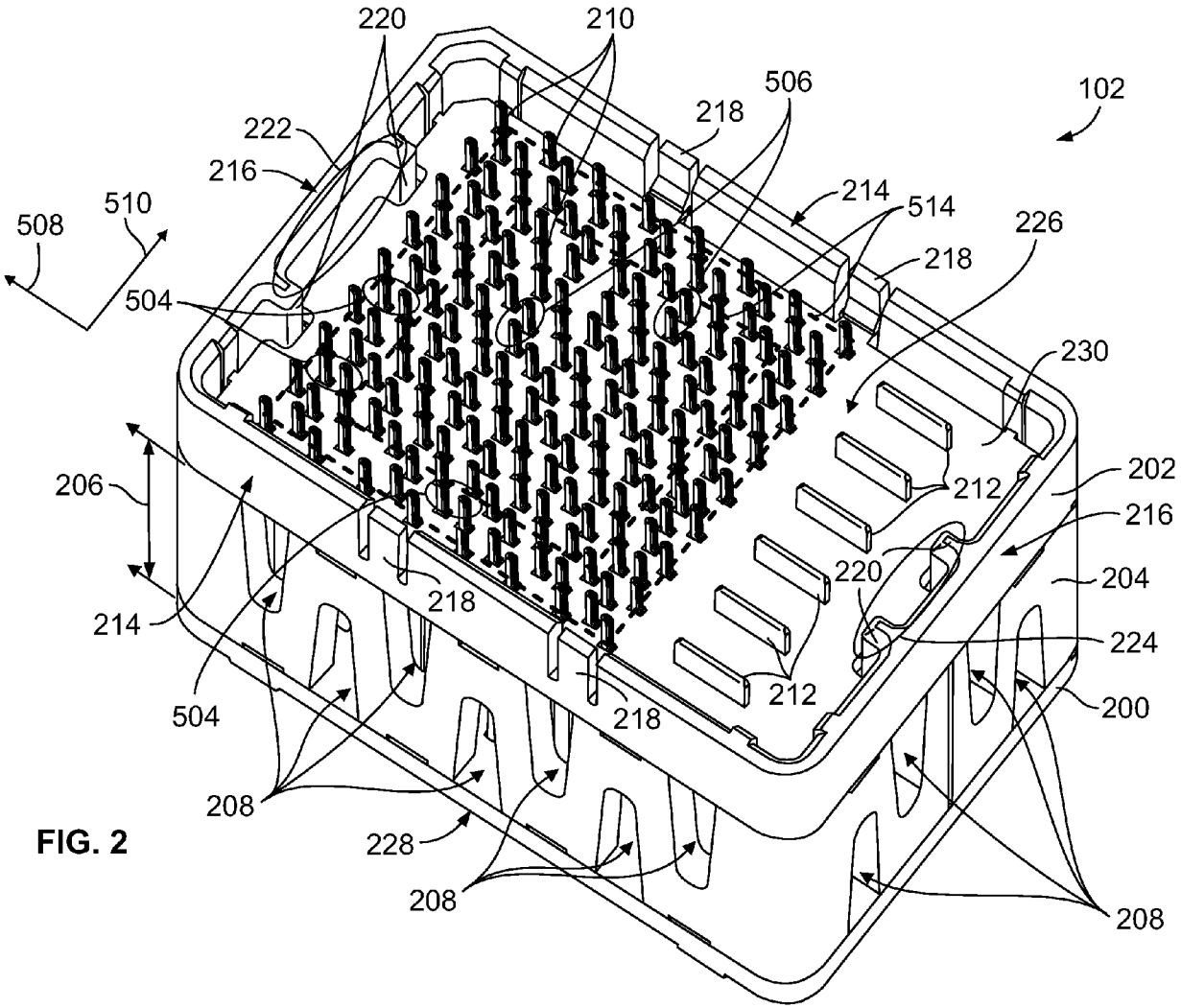
FIG. 2 is a perspective view of a mezzanine connector assembly shown in FIG. 1.

FIG. 2 is a perspective view of the mezzanine connector assembly 102. The mezzanine connector assembly 102 includes a housing composed of a mounting body 200 and a mating body 202 interconnected by a spacer body 204. A contact organizer 230 is disposed proximate to the mating body 202. One or more of the mounting and mating bodies 200, 202 may be a unitary body. For example, each of the mounting and mating bodies 200, 202 may be homogeneously formed of a dielectric material, such as a plastic material. The contact organizer 230 may be formed as a unitary body with the mating body 202.

The mounting body 200 includes a mounting interface 228 that engages the lower substrate 104 (shown in FIG. 1) when the mezzanine connector assembly 102 is mounted to the lower substrate 104. The contact organizer 230 comprises a mating face 226 that engages the upper substrate 106 (shown in FIG. 1) when the mezzanine connector assembly 102 mates with the mating connector 108 (shown in FIG. 1) and/or the upper substrate 106. The mating face 226 is at least partially bounded by plurality of sidewalls 214 and a plurality of end walls 216. The mating face 226 engages the upper substrate 106 (shown in FIG. 1) when the mezzanine connector assembly 102 is mated with the upper substrate 106. For example, the mating face 226 may directly engage the upper substrate 106 or the mating face 226 may engage the mating connector 108 that is mounted to the upper substrate 106. The sidewalls and end walls 214, 216 protrude from the mezzanine connector assembly 102 in a direction perpendicular to the upper and lower substrates 106, 104 (shown in FIG. 1). The sidewalls 214 and end walls 216 form a shroud in which at least a portion of the mating connector 108 (shown in FIG. 1) is received when the mezzanine connector assembly 102 and the mating connector 108 mate with one another.

The sidewalls 214 include latches 218 in the illustrated embodiment. The latches 218 may engage the connector organizer 230 when the connector organizer 230 is placed between the sidewalls 214. Alternatively, one or more of the end walls 216 may include one or more latches 218.

The end walls 216 include polarization features 220 in the illustrated embodiment. The polarization features 220 are shown as columnar protrusions that extend inward from the end walls 216. The polarization features 220 are received in corresponding slots 624 (shown in FIG. 6) in the mating connector 108 (shown in FIG. 1) to properly orient the mating connector 108 and the mezzanine connector assembly 102 with respect to one another. For example, one set 222 of the polarization features 220 may be displaced farther apart from one another when compared to another set 224 of the polarization features 220. Each of corresponding sets 626, 628 (shown in FIG. 6) of slots 624 in the mating connector 108 that receive the polarization features 220 are separated by matching distances such that the mating connector 108 and the mezzanine connector assembly 102 may only be mated in one orientation.

The spacer body 204 separates the mating and mounting bodies 202, 200 by a separation gap 206. The spacer body 204 extends between the mating and mounting bodies 202, 200 in a direction transverse to both the mating and mounting bodies 202, 200. For example, the spacer body 204 may be perpendicular to the mating and mounting bodies 202, 200. In the illustrated embodiment, the spacer body 204 has a saw tooth shape with a plurality of openings 208 disposed therein. Alternatively, the spacer body 204 includes a different shape and/or a different number of openings 208. The openings 208 permit air to flow through the mezzanine connector assembly 102 between the mating and mounting bodies 202, 200. For example, air can enter the mezzanine connector assembly 102 through the openings 208 in the spacer body 204. The air can pass through the mezzanine connector 102 between the mating and mounting bodies 202, 200 and exit the mezzanine connector assembly 102 through the openings 208. Permitting air to flow through the mezzanine connector 102 provides an additional channel of air flow between the upper and lower substrates 104, 106. Additional components (not shown) on the upper and lower substrates 104, 106 can produce thermal energy, or heat. The air flow between the upper and lower substrates 104, 106 may reduce this heat by cooling the components. The openings 208 though the mezzanine connector 102 permits the air to flow through the mezzanine connector 102 and prevents the mezzanine connector 102 from overly restricting the air flow between the upper and lower substrates 104, 106.

Thermal energy, or heat, may be generated inside the mezzanine connector assembly 102 as the mezzanine connector assembly 102 communicates electric power between the lower and upper substrates 104, 106 (shown in FIG. 1). The communication of electric power at sufficiently high current can generate thermal energy. As current at which the electric power is communicated increases, the heat that is generated may increase. In order to dissipate this heat, the openings 208 permit access to the interior of the mezzanine connector assembly 102. For example, the openings 208 permit air to flow between the mounting and mating bodies 200, 202 through the mezzanine connector assembly 102, as described above. One or more fans (not shown) or other components may generate the air flow through the mezzanine connector assembly 102. Separating the mounting and mating bodies 200, 202 by the separation gap 206 and permitting air to flow between the mounting and mating bodies 200, 202 through the spacer body 204 may reduce the heat within the mezzanine connector assembly 102.

The mezzanine connector assembly 102 includes a plurality of signal contacts 210 and a plurality of power contacts 212. A different number of signal contacts 210 and/or power contacts 212 that those shown in FIG. 2 may be provided. The signal contacts 210 mate with the mating connector 108 (shown in FIG. 1) and the lower substrate 104 (shown in FIG. 1) to communicate data signals between the upper and lower substrates 106, 104 (shown in FIG. 1) and/or provide an electrical ground connection between the upper and lower substrates 106, 104. For example, the signal contacts 210 may electrically communicate information, control signals, data, and the like, between the upper and lower substrates 106, 104. The signal contacts 210 may generate some thermal energy or heat as the data signals are communicated using the signal contacts 210. The signal contacts 210 protrude from the mating body 200 to mate with the mating connector 108 (shown in FIG. 1). Alternatively, the signal contacts 210 may protrude from the mating body 200 to mate with the upper substrate 106 (shown in FIG. 1).

The signal contacts 210 extend through the mezzanine connector assembly 102 between the mating and mounting bodies 202, 200 and protrude through the mounting body 200. The signal contacts 210 protrude from the mounting body 200 to mate with the lower substrate 104 (shown in FIG. 1). At least a portion of the signal contacts 210 is exposed in the mezzanine connector assembly 102 between the mating and mounting bodies 202, 200. For example, a portion of the signal contacts 210 may be exposed to the atmosphere or air within the mezzanine connector assembly 102 and not encompassed or held by another component of the mezzanine connector assembly 102 within the separation gap 206 between the mating and mounting bodies 202, 200. Exposing portions of the signal contacts 210 within the separation gap 206 of the mezzanine connector assembly 102 may more easily permit the thermal energy or heat generated by the communication of data signals using the signal contacts 210 to be dissipated. For example, the air flow through the mezzanine connector assembly 102 may dissipate the heat generated by the signal contacts 210 so that the signal contacts 210 may operate at increased data rates over known mezzanine connectors.

In one embodiment, the signal contacts 210 are arranged in a differential signal contact pattern. For example, the signal contacts 210 may be arranged in a plurality of pairs 504, 506 oriented in transverse directions 508, 510, with a plurality of the signal contacts 210 arranged in concentric grounding rings 514. The directions 508, 510 may be perpendicular to one another. The signal contacts 210 held in each of the pairs 504, 506 may communicate a differential pair data signal. The signal contacts 210 in the rings 514 may provide an electrical connection to an electrical ground in one or more of the upper and lower substrates 106, 104 (shown in FIG. 1). The signal contacts 210 may be arranged in the differential signal contact pattern described in co-pending U.S. patent application Ser. No. 12/250,268, filed Oct. 13, 2008, entitled "Connector Assembly Having a Noise-Reducing Contact Pattern" (referred to herein as the "'268 application"). The entire disclosure of the '268 application is incorporated by reference herein in its entirety.

The power contacts 212 mate with the mating connector 108 (shown in FIG. 1) and the lower substrate 104 (shown in FIG. 1) to communicate electric power between the upper and lower substrates 106, 104 (shown in FIG. 1). For example, the power contacts 212 may electrically communicate electric current from the lower substrate 104 to the upper substrate 106. The current may be drawn by electric components (not shown) electrically connected with the upper substrate 106 to power the components. The power contacts 212 may generate thermal energy or heat as the electric power is communicated. The power contacts 212 protrude from the mating body 200 to mate with the mating connector 108 (shown in FIG. 1). Alternatively, the power contacts 212 may protrude from the mating body 200 to mate with the upper substrate 106 (shown in FIG. 1).

The power contacts 212 extend through the mezzanine connector assembly 102 between the mating and mounting bodies 202, 200 and protrude through the mounting body 200. The power contacts 212 protrude from the mounting body 200 to mate with the lower substrate 104 (shown in FIG. 1). At least a portion of the power contacts 212 is exposed in the mezzanine connector assembly 102 between the mating and mounting bodies 202, 200. For example, a portion of the power contacts 212 may be exposed to the atmosphere or air within the mezzanine connector assembly 102 and not encompassed or held by another component of the mezzanine connector assembly 102 within the separation gap 206 between the mating and mounting bodies 202, 200. Exposing portions of the power contacts 212 within the separation gap 206 of the mezzanine connector assembly 102 may more easily permit the thermal energy or heat generated by the communication of electric power using the power contacts 212 to be dissipated. For example, the air flow through the mezzanine connector assembly 102 may dissipate the heat generated by the power contacts 212 so that the power contacts 212 may supply greater electric current from one of the substrates 104, 106 to the other substrate 104, 106.

The mezzanine connector assembly 102 provides both of the signal and power contacts 210, 212 in a single connector. The mezzanine connector assembly 102 provides both the signal and power contacts 210, 212 to communicate both data signals and electric power without requiring the addition of other connectors (not shown) to communicate either the data signals or electric power. The mezzanine connector assembly 102 may be provided in a variety of dimensions to separate the substrates 104, 106 by a desired stack height 110. For example, a set of mezzanine connector assemblies 102 may provide for varying stack heights 110.

Figure 3:
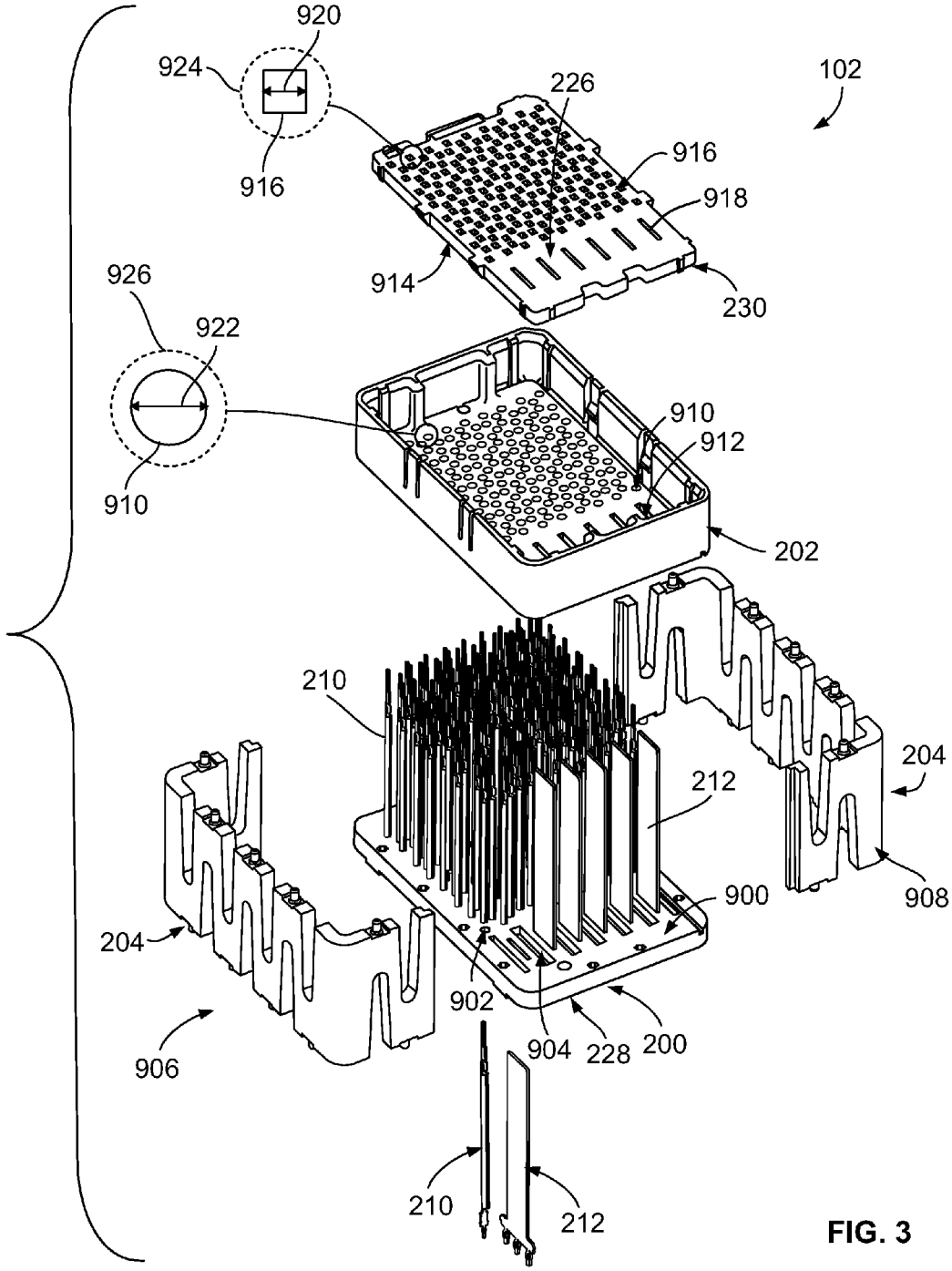
FIG. 3 is an exploded view of the mezzanine connector assembly shown in FIG. 1.

FIG. 3 is an exploded view of the mezzanine connector assembly 102. As shown in FIG. 3, the mating body 202, mounting body 200 and contact organizer 230 are substantially parallel with respect to one another in the illustrated embodiment. The mounting body 200 extends between the mounting interface 228 and an opposing opposite interface 900. The mounting and loading interfaces 228, 900 include signal contact openings 902 and power contact openings 904 that extend through the mounting body 200. The signal and power contacts 210, 212 are loaded into the signal contact openings 902 and power contact openings 904 through the mounting interface 228. Alternatively, the signal and power contacts 210, 212 are loaded into the signal contact openings 902 and power contact openings 904 through the opposite interface 900. The signal and power contacts 210, 212 protrude from the mounting interface 228 in the illustrated embodiment. The spacer body 204 includes two body sections 906, 908. Alternatively, the spacer body 204 may include a different number of sections or be formed as a unitary body.

The mating body 202 includes signal and power contact openings 910, 912 that extend through the mating body 202. The signal and power contacts 210, 212 are loaded through the mating body 202 through the signal and power contact openings 910, 912, respectively. The contact organizer 230 extends between a loading side 914 and the mating face 226. The contact organizer 230 includes signal and power contact openings 916, 918 that extend through the contact organizer 230 between the loading side 914 and the mating face 226. The signal and power contacts 210, 212 are loaded through the signal and power contact openings 916, 918 such that the signal and power contacts 210, 212 at least partially protrude from the mating face 226. Each of the signal contact openings 916 in the contact organizer 230 and the signal contact openings 910 in the mating body 202 include an inside dimension 920, 922. For example, as shown in the magnified views 924, 926, the inside dimensions 920, 922 extend across the insides of the signal contact openings 916 in the contact organizer 230 and the signal contact openings 910 in the mating body 202, respectively. The inside dimension 922 of the signal contact opening 910 in the mating body 202 is larger than the inside dimension 920 of the signal contact opening 916 in the contact organizer 230. The inside dimension 922 may be larger than the inside dimension 920 to permit greater tolerances in loading the signal contacts 210 through the mating body 202 prior to loading the signal contacts 210 through the contact organizer 230. Alternatively, the inside dimension 920 may be the same size as, or smaller than, the inside dimension 922.

Figure 4:
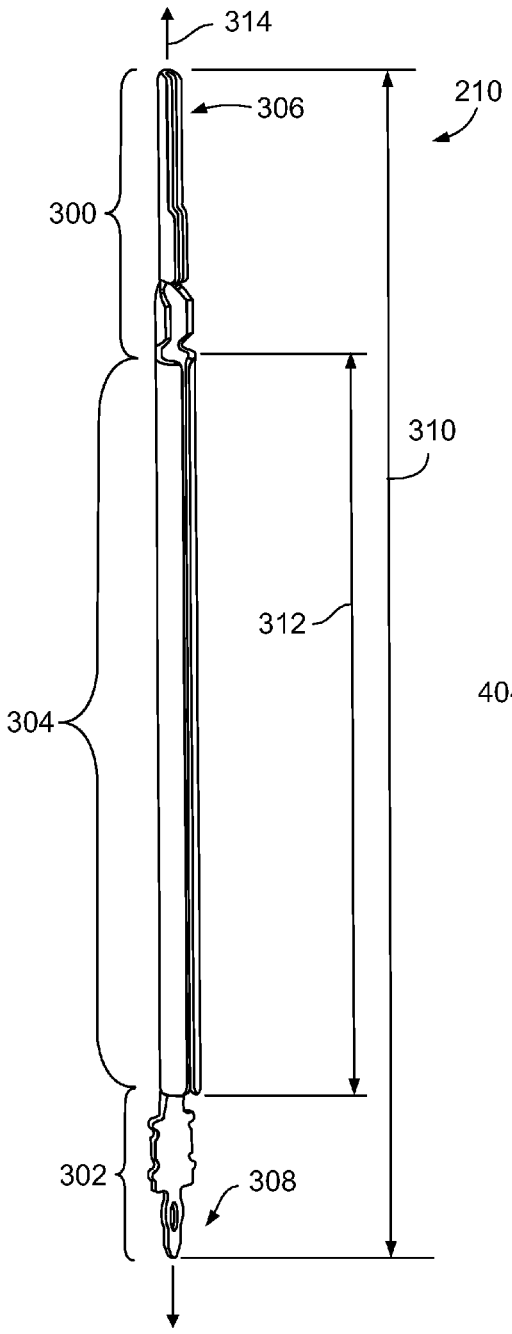
FIG. 4 is a perspective view of a signal contact shown in FIG. 2 according to one embodiment.

FIG. 4 is a perspective view of the signal contact 210 according to one embodiment. The signal contact 210 includes a signal mating end 300 coupled to a signal mounting end 302 by a signal contact body 304. The signal contact 210 has an elongated shape oriented along a longitudinal axis 314. The signal mating and mounting ends 300, 302 extend from the signal contact body 304 in opposite directions along the longitudinal axis 314. The signal contact 210 includes, or is formed from, a conductive material. For example, the signal contact 210 may be stamped and formed from a sheet of metal. Alternatively, the signal contact 210 may be formed from a dielectric material with at least a portion of the signal contact 210 plated with a conductive material.

The signal mating end 300 protrudes from the mating body 202 (shown in FIG. 2) of the mezzanine connector assembly 102 (shown in FIG. 1). The signal mating end 300 mates with the mating connector 108 (shown in FIG. 1). Alternatively, the signal mating end 300 mates with the upper substrate 106 (shown in FIG. 1). The signal mating end 300 includes a mating pin 306 that is received by a corresponding contact (not shown) in the mating connector 108 or the upper substrate 106. In another embodiment, the signal mating end 300 includes a receptacle that receives the corresponding contact in the mating connector or upper substrate 106. The signal mating end 300 is electrically connected with at least one of the conductive pathways 118 (shown in FIG. 1) in the upper substrate 106 when the signal mating end 300 is mated with the mating connector 108 or the upper substrate 106.

The signal mounting end 302 is mounted to the lower substrate 104 (shown in FIG. 1). The signal mounting end 302 includes a mounting pin 308 that is loaded into a cavity (not shown) in the lower substrate 104. For example, the mounting pin 308 may be received by a plated cavity in the lower substrate 104 that is electrically connected to at least one of the conductive pathways 120 in the lower substrate 104. The signal mounting end 302 is electrically connected with at least one of the conductive pathways 120 in the lower substrate 104 when the signal mounting end 302 is mounted to the lower substrate 104. As shown in FIG. 4, the signal contact body 304 has a tubular shape, although other shapes are contemplated within the embodiments described herein. The signal contact body 304 is disposed between the signal mating and mounting ends 300, 302. The signal contact body 304 is exposed in the separation gap 206 (shown in FIG. 2) within the mezzanine connector assembly 102. For example, at least a portion of the signal contact body 304 is exposed to the air or atmosphere within the mezzanine connector assembly 102 between the mating and mounting bodies 202, 200. Air flow through the mezzanine connector assembly 102 between the mating and mounting bodies 202, 200 may increase the rate of dissipation of thermal energy or heat generated by the signal contact 210. The thermal energy or heat is dissipated from the signal contact body 304.

An overall length 310 of the signal contact 210 can be varied to adjust the stack height 110 (shown in FIG. 1) between the upper and lower substrates 106, 104 (shown in FIG. 1). For example, if the overall length 310 of the signal contacts 210 loaded into the mezzanine connector assembly 102 (shown in FIG. 1) is increased, the upper and lower substrates 106, 104 may be separated by an increased distance. Alternatively, a length 312 of the signal contact body 304 can be varied to change the overall length 310 of the signal contact 210. The length 312 of the signal contact body 304 is the portion of the overall length 310 of the signal contact 210 that is exposed between the mating and mounting bodies 202, 200 (shown in FIG. 2) of the mezzanine connector assembly 102. Adjusting the overall length 310 and/or the length 312 of the signal contact body 304 provides an operator of the mezzanine connector assembly 102 with the ability to select a desired stack height 110 (shown in FIG. 1) between the upper and lower substrates 106, 104. For example, if an operator wants the upper and lower substrates 106, 104 to be separated by a greater stack height 110, then the operator can select signal contacts 210 with a greater overall length 310 and/or length 312 of the signal contact body 304. In another example, if the operator wants the upper and lower substrates 106, 104 to be separated by a lesser stack height 110, then the operator can select signal contacts 210 with a lesser overall length 310 and/or length 312 of the signal contact body 304.

Figure 5:
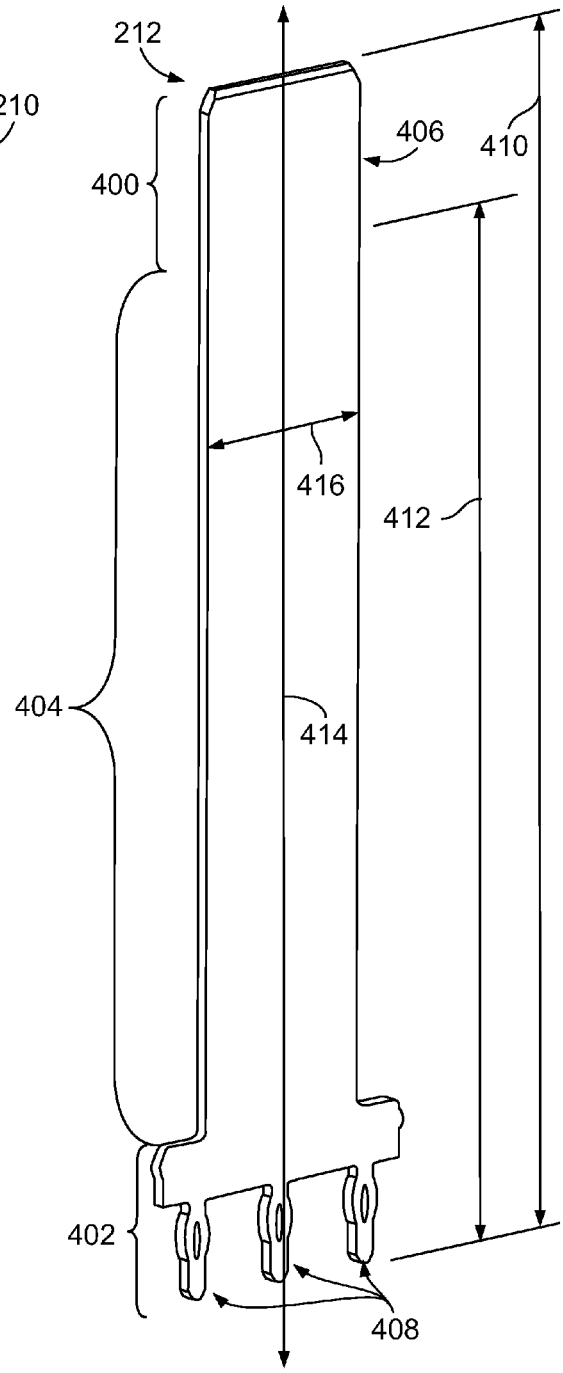
FIG. 5 is a perspective view of a power contact shown in FIG. 2 according to one embodiment.

FIG. 5 is a perspective view of the power contact 212 according to one embodiment. The power contact 212 includes a power mating end 400 coupled to a power mounting end 402 by a power contact body 404. The power contact 212 has an elongated shape oriented along a longitudinal axis 414. The power mating and mounting ends 400, 402 extend from the power contact body 404 in opposite directions along the longitudinal axis 414. The power contact 212 includes, or is formed from, a conductive material. For example, the power contact 212 may be stamped and formed from a sheet of metal. Alternatively, the power contact 212 may be formed from a dielectric material with at least a portion of the power contact 212 plated with a conductive material.

The power mating end 400 protrudes from the mating body 202 (shown in FIG. 2) of the mezzanine connector assembly 102 (shown in FIG. 1). The power mating end 400 mates with the mating connector 108 (shown in FIG. 1). Alternatively, the power mating end 400 mates with the upper substrate 106 (shown in FIG. 1). The power mating end 400 includes a mating blade 406 that is received by a corresponding contact (not shown) in the mating connector 108 or the upper substrate 106. In another embodiment, the power mating end 400 has a shape other than that of a blade. For example, the power mating end 400 may include a mating pin. The power mating end 400 optionally may include a receptacle that receives the corresponding contact in the mating connector or upper substrate 106. The power mating end 400 is electrically connected with at least one of the conductive pathways 118 (shown in FIG. 1) in the upper substrate 108 when the power mating end 400 is mated with the mating connector 108 or the upper substrate 106.

The power mounting end 402 is mounted to the lower substrate 104 (shown in FIG. 1). The power mounting end 402 includes mounting pins 408 that are loaded into cavities (not shown) in the lower substrate 104. For example, the mounting pins 408 may be received by a plated cavity in the lower substrate 104 that is electrically connected to at least one of the conductive pathways 120 in the lower substrate 104. While three mounting pins 408 are shown in FIG. 5, a different number of mounting pins 408 may be provided. The power mounting end 402 is electrically connected with at least one of the conductive pathways 120 in the lower substrate 104 when the power mounting end 402 is mounted to the lower substrate 104. The power contact body 404 is disposed between the power mating and mounting ends 400, 402.

The power contact body 404 has an outside width 416 in a direction transverse to the longitudinal axis 414. For example, the power contact body 404 has a width 416 in a direction perpendicular to the longitudinal axis 414 such that the power contact body 404 has a planar shape in a plane defined by the longitudinal axis 414 and the width 416 of the power contact body 404. The planar shape of the power contact body 404 may be continued in the power mating end 400 and/or the power mounting end 402 as shown in the illustrated embodiment. Alternatively, the shape of the power contact body 404 may differ from the shape of the power mating end 400 and/or the power mounting end 402. The power contact body 404 may be larger than the signal contact body 304 (shown in FIG. 4) to permit the power contact body 404 to communicate a greater electric current than the signal contact body 304. The power contact body 404 is exposed in the separation gap 206 (shown in FIG. 2) within the mezzanine connector assembly 102. For example, at least a portion of the power contact body 404 is exposed to the air or atmosphere within the mezzanine connector assembly 102 between the mating and mounting bodies 202, 200. Air flow through the mezzanine connector assembly 102 between the mating and mounting bodies 202, 200 may increase the rate old dissipation of thermal energy or heat generated by the power contact 212. The thermal energy or heat is dissipated from the power contact body 404.

An overall length 410 of the power contact 212 can be varied to adjust the stack height 110 (shown in FIG. 1) between the upper and lower substrates 106, 104 (shown in FIG. 1). For example, if the overall length 410 of the power contacts 212 loaded into the mezzanine connector assembly 102 (shown in FIG. 1) is increased, the upper and lower substrates 106, 104 may be separated by an increased distance. Alternatively, a length 412 of the power contact body 404 can be varied to change the overall length 410 of the power contact 212. The length 412 of the power contact body 404 is the portion of the overall length 410 of the power contact 212 that is exposed between the mating and mounting bodies 202, 200 (shown in FIG. 2) of the mezzanine connector assembly 102. Adjusting the overall length 410 and/or the length 412 of the power contact body 404 provides an operator of the mezzanine connector assembly 102 with the ability to select a desired stack height 110 (shown in FIG. 1) between the upper and lower substrates 106, 104. For example, if an operator wants the upper and lower substrates 106, 104 to be separated by a greater stack height 110, then the operator can select power contacts 212 with a greater overall length 410 and/or length 412 of the power contact body 404. In another example, if the operator wants the upper and lower substrates 106, 104 to be separated by a lesser stack height 110, then the operator can select power contacts 212 with a lesser overall length 410 and/or length 412 of the power contact body 404.

Figure 6:
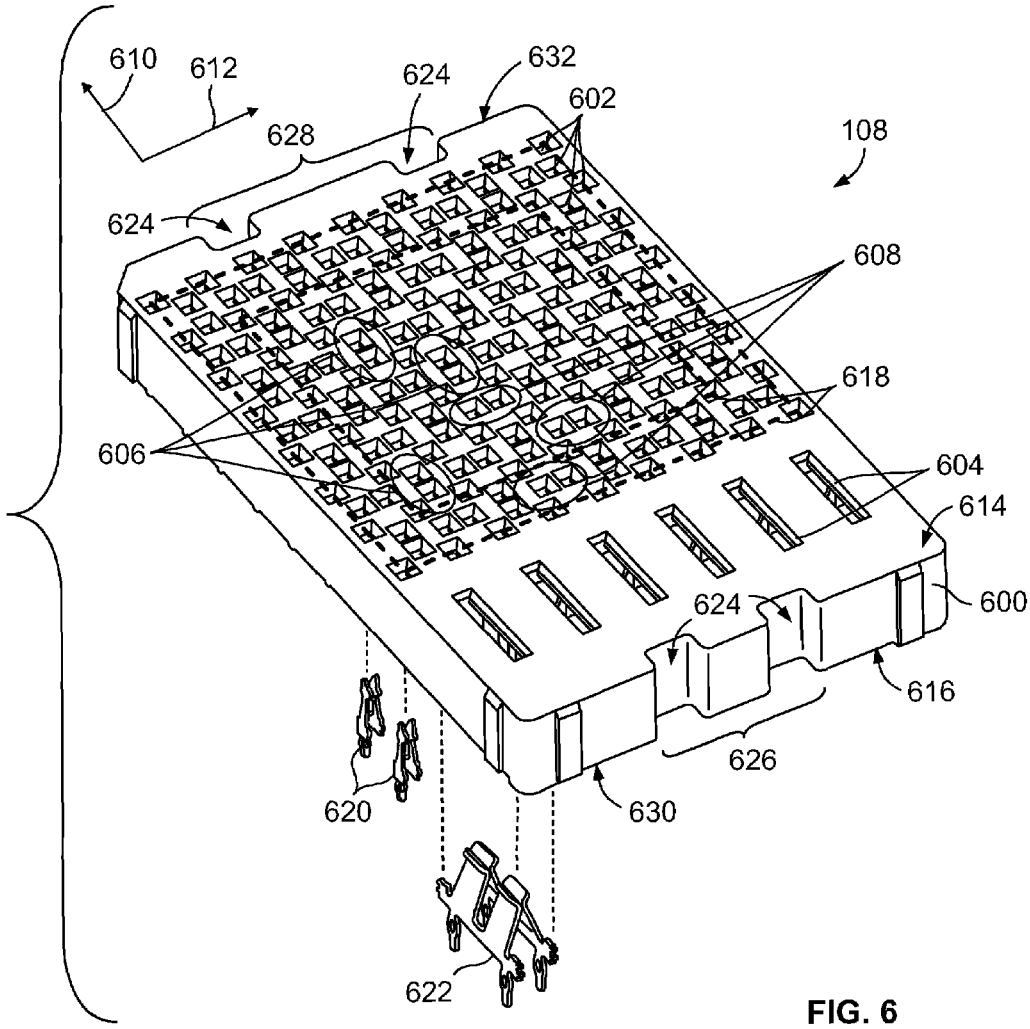
FIG. 6 is a perspective view of a mating connector shown in FIG. 1 according to one embodiment.

FIG. 6 is a perspective view of the mating connector 108 according to one embodiment. The mating connector 108 includes a connector body 600 with a plurality of signal contact cavities 602 and power contact cavities 604 disposed therein. The body 600 may be a unitary body. For example, the body 600 may be homogeneously formed from a dielectric material. The body 600 extends between a mating interface 614 and a mounting interface 616. The mating and mounting interfaces 614, 616 are approximately parallel in the illustrated embodiment, although other arrangements are within the scope of the embodiments described herein. The mating interface 614 engages the mating body 202 (shown in FIG. 2) of the mezzanine connector assembly 102 (shown in FIG. 1) when the mezzanine connector assembly 102 and mating connector 108 mate with one another. The mounting interface 616 engages the upper substrate 106 (shown in FIG. 1) when the mating connector 108 is mounted to the upper substrate 106.

The signal contact cavities 602 receive the signal contacts 210 (shown in FIG. 2) when the mating connector 108 and the mezzanine connector assembly 102 mate with one another. The power contact cavities 604 receive the power contacts 212 (shown in FIG. 2) when the mating connector 108 and the mezzanine connector assembly 102 mate with one another. The signal contact cavities 602 may be arranged in a differential pair contact pattern similar to the differential pair contact pattern described in the '268 application. For example, the signal contact cavities 602 may be arranged in pairs 606, 608 oriented in transverse directions 610, 612 with respect to one another, with a plurality of the signal contact cavities 602 arranged in concentric rings 618. The transverse directions 610, 612 may be perpendicular to one another.

Mating signal contacts 620 are loaded into the signal contact cavities 602 through the mounting interface 616. The mating signal contacts 620 engage the signal contacts 210 (shown in FIG. 2) when the mating connector 108 and the mezzanine connector assembly 102 (shown in FIG. 1) mate with one another. The mating signal contacts 620 are mounted to the upper substrate 106 (shown in FIG. 1) when the mating connector 108 is mounted to the upper substrate 106. The mating signal contacts 620 electrically connect the mating connector 108 with one or more of the conductive pathways 108 (shown in FIG. 1) in the upper substrate 106.

Mating power contacts 622 are loaded into the power contact cavities 604 through the mounting interface 616. The mating power contacts 622 engage the power contacts 212 (shown in FIG. 2) when the mating connector 108 and the mezzanine connector assembly 102 (shown in FIG. 1) mate with one another. The mating power contacts 622 are mounted to the upper substrate 106 (shown in FIG. 1) when the mating connector 108 is mounted to the upper substrate 106. The mating power contacts 622 electrically connect the mating connector 108 with one or more of the conductive pathways 108 (shown in FIG. 1) in the upper substrate 106.

The body 600 includes sets 626, 628 of polarization slots 624 in opposite ends 630, 632 of the body 600. The polarization slots 624 receive the polarization features 220 (shown in FIG. 2) of the mezzanine connector assembly 102 (shown in FIG. 1). For example, the set 222 (shown in FIG. 2) of polarization features 220 may be received in the set 628 of polarization slots 624 and the set 224 (shown in FIG. 2) of polarization features 220 may be received in the set 626 of polarization slots 624. As the sets 222, 224 of the polarization features 220 are spaced apart differently from one another and the sets 626, 628 of the polarization slots 624 are spaced apart differently from one another, only the set 628 of polarization slots 624 can receive the set 222 of polarization features 220 and the set 626 of polarization slots 624 only can receive the set 224 of polarization features 220. The receipt of the polarization features 220 into the polarization slots 624 may help to properly align the mating connector 108 with respect to the mezzanine connector assembly 102.

Figure 7:
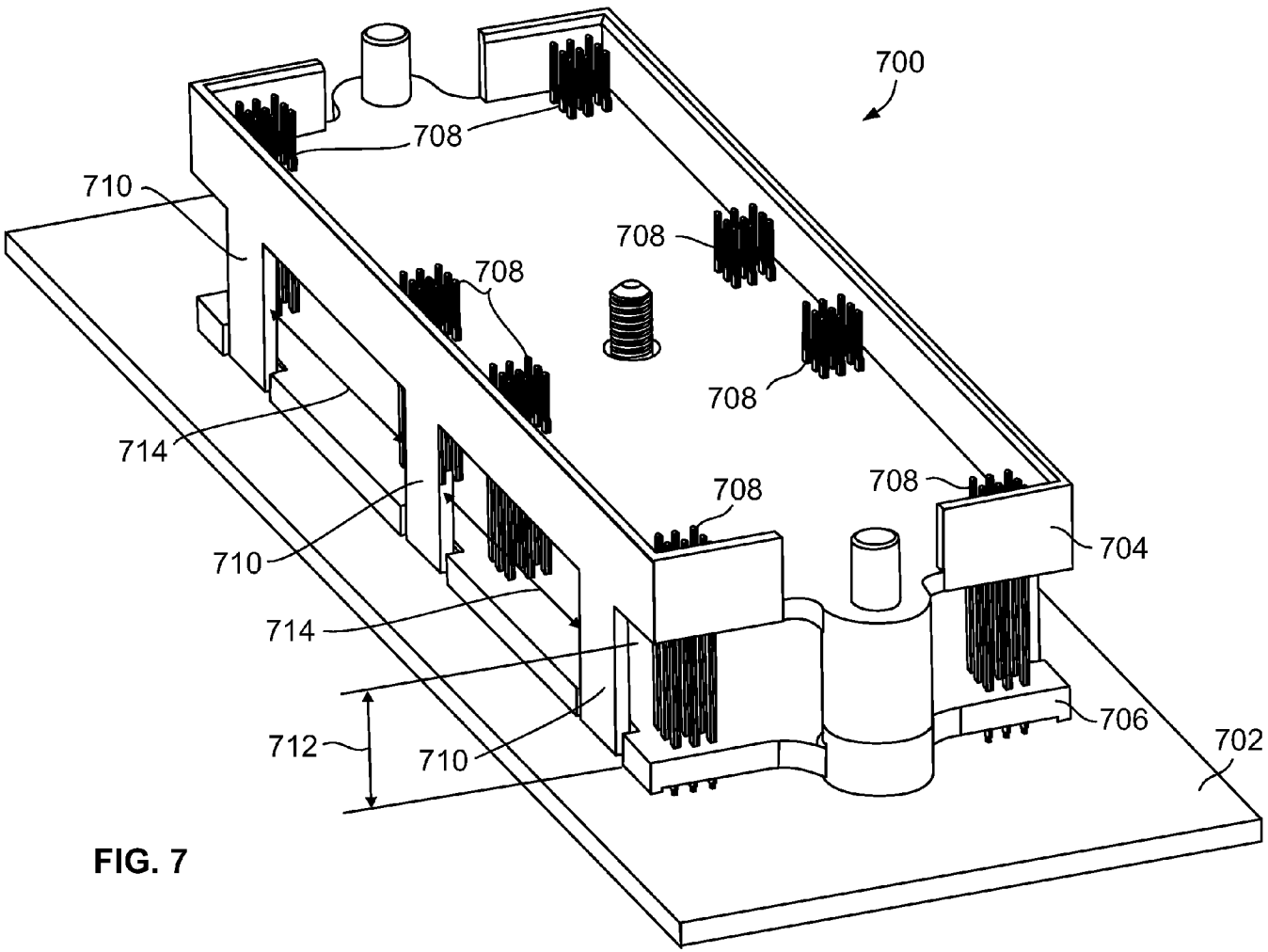
FIG. 7 is a perspective of a mezzanine connector assembly according to an alternative embodiment.

FIG. 7 is a perspective of a mezzanine connector assembly 700 according to an alternative embodiment. The mezzanine connector assembly 700 may be similar to the mezzanine connector assembly 102 (shown in FIG. 1) described above. For example, the mezzanine connector assembly 700 mechanically and electrically interconnects an upper substrate (not shown, but may be similar to the upper substrate 106 shown in FIG. 1) with a lower substrate 702 in a parallel arrangement. The lower substrate 702 may be similar to the lower substrate 104 (shown in FIG. 1).

The mezzanine connector assembly 700 includes a mating body 704 coupled with a mounting body 706. The mating and mounting bodies 704, 706 may each be separately formed as unitary bodies. For example, each of the mating and mounting bodies 704, 706 may be homogeneously formed from a dielectric material independent of one another. Similar to the mating and mounting bodies 202, 200 (shown in FIG. 2) of the mezzanine connector assembly 102, the mating and mounting bodies 704, 706 hold a plurality of contacts 708. The contacts 708 may include signal and/or power contacts 210, 212 (shown in FIG. 2) similar to the mezzanine connector assembly 102.

One difference between the mezzanine connector assemblies 102, 700 is that the mezzanine connector assembly 700 includes a plurality of columns 710 that couple the mating and mounting bodies 704, 706. The columns 710 may be formed as part of the mating body 704 as shown in FIG. 7. For example, the columns 710 and the mating body 704 may be components of the same unitary body. Alternatively, the columns 710 may be formed as part of the mounting body 706. The columns 710 engage the mounting body 706 such that the mating and mounting bodies 704, 706 are separated by a separation gap 712. The separation gap 712 between the mating and mounting bodies 704, 706 permits air to flow between the mating and mounting bodies 704, 706 and dissipate heat generated by the contacts 708, similar to as described above. The columns 710 are separated from one another by an inside dimension 714. The inside dimension 714 may be greater than the size of the openings 208 (shown in FIG. 2). For example, the columns 710 may be separated from one another such that a greater flow of air measured in cubic feet per minute may pass through the mezzanine connector assembly 700 between the mating and mounting bodies 704, 706 than the flow of air through the mezzanine connector assembly 102 (shown in FIG. 1.) between the mating and mounting bodies 202, 200 (shown in FIG. 2).

Figure 8:
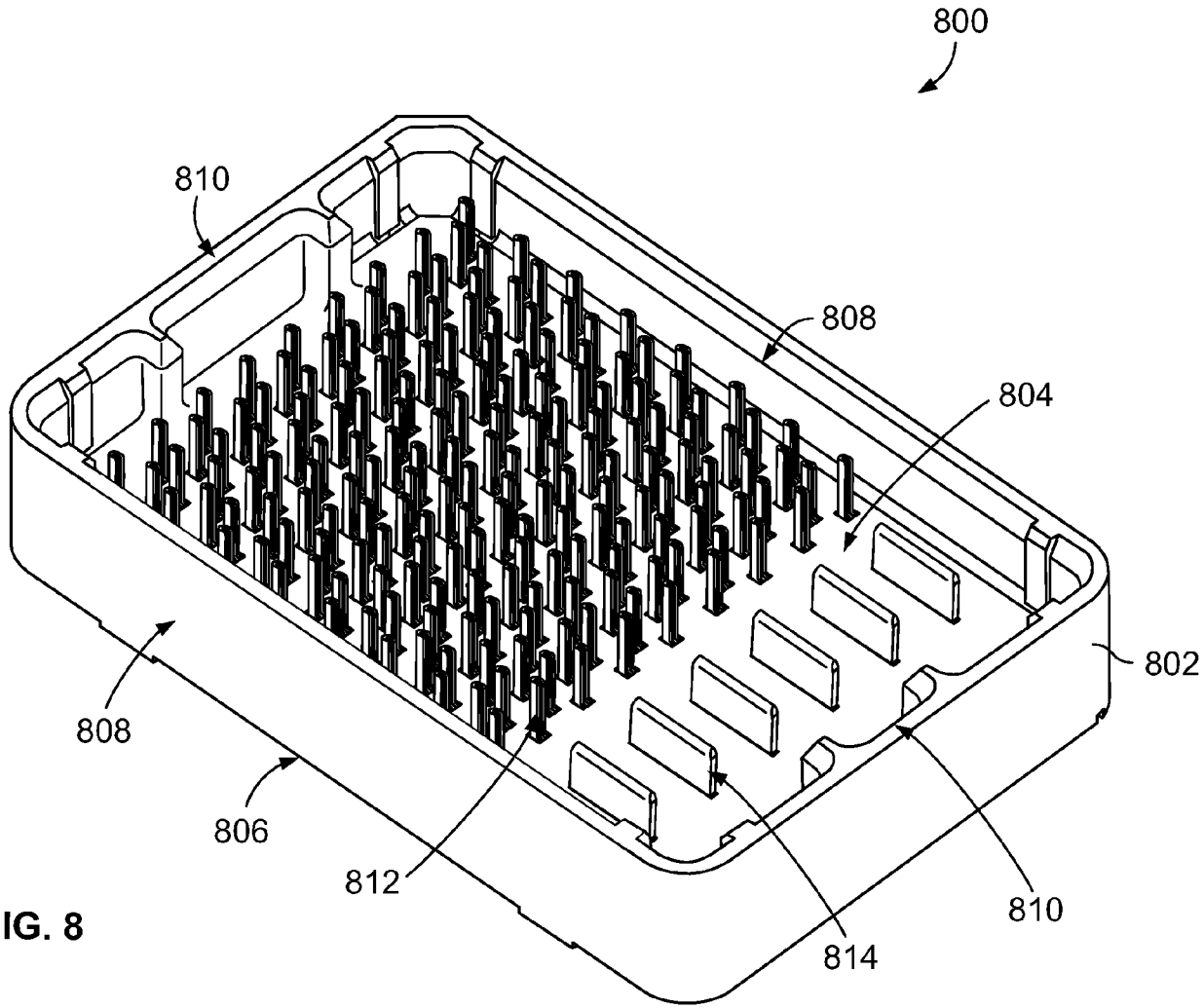
FIG. 8 is a perspective view of a mezzanine connector according to an alternative embodiment.

FIG. 8 is a perspective view of a mezzanine connector 800 according to an alternative embodiment. The mezzanine connector 800 includes a housing 802 that extends between a mating face 804 and a mounting interface 806. The housing 800 may be a unitary body. For example, the housing 800 may be homogeneously formed of a dielectric material, such as a plastic material. The mating face 804 is at least partially bounded by plurality of sidewalls 808 and a plurality of end walls 810, similar to the sidewalls 214 and end walls 216 shown in FIG. 2. The mating face 804 engages the upper substrate 106 (shown in FIG. 1) similar to the mating face 226 (shown in FIG. 2). Signal contacts 812 and power contacts 814 extend through the housing 802 similar to the signal contacts 210 (shown in FIG. 2) and the power contacts 212 (shown in FIG. 2). One difference between the mezzanine connector 800 and the mezzanine connector 102 (shown in FIG. 1) is that no spacer body is included in the mezzanine connector 800. For example, the mating face 804 and the mounting interface 806 are not separated by a gap that permits air to flow through the mezzanine connector 800. The mezzanine connector 800 may provide a smaller profile or smaller stack height 110 (shown in FIG. 1) between the substrates 104, 106 than the mezzanine connector 102.

Known mezzanine connectors include contacts for providing data signals but not electric power. The known mezzanine connectors require the addition of other connectors to supply electric power between the circuit boards coupled by the mezzanine connectors. The additional connectors must be of the same height as the mezzanine, connectors in order to maintain the stack height between the circuit boards interconnected by the mezzanine connectors. Finding connectors of the same height may be difficult and may limit the range of mezzanine connectors that may be used to couple two circuit boards in a parallel relationship. As described above, one or more embodiments described herein provide a single mezzanine connector assembly that includes both signal and power contacts while providing a consistent stack height between substrates that are interconnected by the connector assembly in a parallel relationship. The mezzanine connector assemblies described above may concurrently provide for the communication of both data signals and electric power between a plurality of substrates coupled with the mezzanine connector assemblies in a parallel relationship.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and merely are example embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a housing having a mating interface and a mounting interface, the mating interface configured to engage an upper substrate and the mounting interface configured to engage a lower substrate to mechanically interconnect the upper and lower substrates;

a signal contact continuously extending between and protruding from the mating and mounting interfaces, the signal contact configured to communicate a data signal between the upper and lower substrates;

a power contact extending between and protruding from the mating and mounting interfaces, the power contact configured to communicate electrical power between the upper and lower substrates, wherein the housing separates the upper and lower substrates by a predetermined stack height; and a contact organizer disposed between the mating interface of the housing and the upper substrate when the housing engages the upper substrate, the contact organizer comprising openings extending therethrough, wherein the signal contact and the power contact mate with the upper substrate by extending through the openings in the contact organizer.

2. The connector assembly of claim 1, wherein a length of the power contact and a length of the signal contact are selected so that the upper and lower substrates are separated by the predetermined stack height.

3. The connector assembly of claim 1, wherein the housing comprises a mating body and a mounting body coupled together by a spacer body, the spacer body providing a gap between the mating and mounting bodies to permit air to flow from outside of the housing and through the housing between the mounting and mating bodies.

4. The connector assembly of claim 1, wherein the signal and power contacts are oriented in a direction transverse to the mating and mounting interfaces.

5. The connector assembly of claim 1, wherein the power contact comprises a substantially planar body oriented transverse to the mating and mounting interfaces.

6. The connector assembly of claim 1, wherein the housing is configured to engage a mating connector mounted to the upper substrate to mechanically and electrically couple the upper and lower substrates.

7. A mezzanine connector comprising:

a housing extending between opposite mating and mounting interfaces, the housing configured to engage a mating connector mounted to a first circuit board at the mating interface and a second circuit board at the mounting interface to mechanically interconnect the first and second circuit boards, the mating and mounting interfaces separated from one another by an air gap that permits air to flow through the housing between the mating and mounting interfaces;

a signal contact held by the housing and configured to mate with the first and second circuit boards to electrically connect the first and second circuit boards and communicate a data signal between the first and second circuit boards;

a power contact held by the housing and configured to mate with the first and second circuit boards to electrically connect the first and second circuit boards and communicate electric power between the first and second circuit boards, wherein the signal and power contacts concurrently mate with the first and second circuit boards to communicate the data signal and the electric power while separating the first and second circuit boards by a predetermined distance; and a contact organizer coupled to the housing and configured to engage the mating connector, the contact organizer comprising openings extending therethrough, wherein the signal contact and the power contact mate with the mating connector by extending through the openings in the contact organizer.

8. The mezzanine connector of claim 7, wherein the housing comprises a first body and a second body coupled to one another and separated by the air gap to permit the air to flow through the housing.

9. The mezzanine connector of claim 7, further comprising a spacer body extending between the mating and mounting interfaces, the spacer body separating the mating and mounting interfaces by the air gap to permit the air to flow between the mating and mounting interfaces.

10. The mezzanine connector of claim 7, wherein the power and signal contacts are exposed to the air within the housing and between the mating and mounting interfaces to dissipate heat generated by the power and signal contacts.

11. The mezzanine connector of claim 7, wherein the housing comprises a shroud configured to receive the mating connector mounted to the first circuit board.

12. The mezzanine connector of claim 11, wherein the shroud comprises at least one of a latch to secure the mating connector to the housing and a polarization feature configured to orient the mating connector with respect to the housing.

13. The connector assembly of claim 1, wherein the housing comprises a mating body and a mounting body separated from one another by a gap, the mating body including the mating interface, the mounting body including the mounting interface, wherein a length of the signal contact and a length of the power contact are larger than the gap in a direction that is transverse to the mating interface and the mounting interface.

14. The connector assembly of claim 1, wherein the housing includes contact openings at the mating interface that are aligned with the openings in the contact organizer, the opening in the contact organizer through which the signal contact extends being smaller than the contact opening in the housing through which the signal contact extends.

15. The connector assembly of claim 1, wherein the power contact continuously extends between and protrudes from the mating and mounting interfaces.

16. The mezzanine connector of claim 7, wherein the housing comprises a mating body and a mounting body separated from one another by the air gap, the mating body including the mating interface, the mounting body including the mounting interface, wherein a length of the signal contact and a length of the power contact are larger than the gap in a direction that is transverse to the mating interface and the mounting interface.

17. The mezzanine connector of claim 7, wherein the housing includes contact openings at the mating interface that are aligned with the openings in the contact organizer, the opening in the contact organizer through which the signal contact extends being smaller than the contact opening in the housing through which the signal contact extends.

18. The mezzanine connector of claim 7, wherein the signal contact continuously extends between and protrudes from each of the mating and mounting interfaces.

* * * * *